US007455065B2

(12) United States Patent
Schrott

(10) Patent No.: US 7,455,065 B2
(45) Date of Patent: Nov. 25, 2008

(54) HOUSEHOLD APPLIANCE

(75) Inventor: Harald Schrott, Lindau (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 247 days.

(21) Appl. No.: 10/515,967

(22) PCT Filed: May 28, 2003

(86) PCT No.: PCT/DE03/01745

§ 371 (c)(1),
(2), (4) Date: Jul. 1, 2005

(87) PCT Pub. No.: WO03/102290

PCT Pub. Date: Dec. 11, 2003

(65) Prior Publication Data

US 2006/0011221 A1 Jan. 19, 2006

(30) Foreign Application Priority Data

May 29, 2002 (DE) ..... 202 08 544 U
May 29, 2002 (DE) ..... 202 08 545 U

(51) Int. Cl.
*B08B 3/00* (2006.01)

(52) U.S. Cl. ..... 134/56 D

(58) Field of Classification Search ..... 134/56 D
See application file for complete search history.

(56) References Cited

U.S. PATENT DOCUMENTS 3,923,073 A * 12/1975 Jacobs ..... 134/57 D
5,450,868 A * 9/1995 Young, Jr. ..... 134/111
2002/0048513 A1* 4/2002 Kleemann et al. ..... 415/175

FOREIGN PATENT DOCUMENTS

| | | | | |
|---|---|---|---|---|
| DE | 197 36 794 A1 | | 2/1999 | |
| DE | 199 32 033 A1 | | 1/2000 | |
| DE | 198 58 137 A1 | | 6/2000 | |
| DE | 199 03 951 A1 | | 8/2000 | |
| DE | 199 16 136 A1 | | 10/2000 | |
| DE | 201 07 363 U1 | | 8/2001 | |
| DE | 200 18 182 U1 | | 1/2002 | |
| EP | 0 906 984 A1 | | 4/1999 | |
| JP | 409148047 | * | 6/1997 | ..... 219/227 |
| JP | 10103297 | * | 4/1998 | |
| WO | WO 03/102 290 A1 | | 12/2003 | |

* cited by examiner

*Primary Examiner*—Frankie L Stinson
*Assistant Examiner*—Samuel A Waldbaum
(74) *Attorney, Agent, or Firm*—William D. Breneman; Breneman & Georges

(57) ABSTRACT

The invention proposes a household appliance, in particular a dishwasher, a washing machine or the like, having a liquid circuit and a pump which has a pump casing which comprises a heating element (3) for heating the liquid, which element is adapted, with a heat-conducting contact area (20), to the outer shape (2) of the casing with an at least partial form fit. In this case, the heating system of the household appliance according to the invention is intended to have an improved efficiency. This is achieved, according to the invention, by the contact area (20) being at least half the size of the entire outer area of the heating element.

14 Claims, 4 Drawing Sheets

HOUSEHOLD APPLIANCE

CROSS REFERENCE TO RELATED APPLICATIONS

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

REFERENCE TO A "MICROFICHE APPENDIX"

Not Applicable.

BACKGROUND OF THE INVENTION (1) Field of the Invention

The invention relates to a household appliance, in particular a washing machine, a dishwasher or the like, having a liquid circuit and a pump having a pump casing with a heating element for heating the liquid. The heating element has a heat conducting contact area with at least a partial form fit into the outer shape of the pump casing with the heat conducting contact area being at least half the size of the entire outer area of the heating element. More particularly the invention pertains to a heating element that is inserted into an outer depression of the pump casing such that the outer depression forms a protrusion on the inside of the pump casing.

(2) Description of Related Art Including Information Disclosed Under 37 C.F.R. 1.97 and 1.98

Document 197 36 794 A1 has disclosed a pump for a dishwasher in which the heating element has been integrated into the pump in the form of a throughflow heater. The construction described therein involves adaptation pieces in the bottom of the machine, in which case the pump cannot be operated as a separate component.

Document DE 201 07 363 U1 has disclosed a water pump in which a heating element is inserted into a continuous bead on the circumference.

Furthermore, document DE 199 16 136 A1 has disclosed a liquid pump for a dishwasher, into which pump a heating element is likewise integrated. In this embodiment, the heating element is fitted on the outside or on the inside of a pump casing which, with the exception of connection pieces, is closed. In this abovedescribed embodiment, expenditure on manufacture and assembly is already considerably reduced as compared with the previous prior art.

Document DE 199 32 033 describes a water pump in which a flat heating element is joined to a cylindrical pipe connection piece and, in the process, additionally bears with one side against the bent-away cover of the pump casing. In this way, approximately half of the surface of the heating element of essentially rectangular cross section bears against the pump casing or the pipe connection piece. A relatively large contact area is not possible with this construction.

BRIEF SUMMARY OF THE INVENTION

The object of the invention is to propose a household appliance having a liquid pump which is heated from the outside and in which higher heating efficiency is possible.

This object is achieved, on the basis of a household appliance of the type mentioned in the field of the invention portion of this Specification and in particular to a heating element that is inserted into an outer depression of a pump casing such that the outer depression forms a protrusion on the inside of the pump casing.

Advantageous embodiments and developments of the invention are possible by forming the outer shape of the casing to enlarge the surface area, making the ratio of dead volume to the total throughput $V_t$ [$cm^3$]/Vq [$cm^3$/sec] to $\leqq 0.2$, making the depression in the annular groove deeper than the corresponding height h of the heating element so that the casing projects beyond the height of the heating element, orienting the inner protrusion along the direction of flow, pressing the heating element against the casing, providing a heat-conducting filler between the heating element and the casing wall, utilizing the heat-conducting filler to secure the heating element, shaping the heating element into an annular segment from a rod-like blank, forming the heating element in the shape of a spiral, forming the heating element into a serpentine or zigzag shape and fitting the heating element on a casing part.

Accordingly, in a household appliance according to the invention, the heating element is adapted, with a heat-conducting or heat-transferring contact area, to the outer shape of the pump casing with an at least partial form fit such that the contact area is at least half the size of the entire outer area of the heating element. This allows direct thermal contact to be produced between the heating element and the corresponding casing part of the pump over a large surface area, as a result of which the efficiency of the heating system is increased.

Furthermore, according to the invention, the pump casing of the liquid pump is provided with an outer depression into which the heating element is inserted.

Insertion into a depression of this type enlarges the contact area between the corresponding casing part and the heating element, as a result of which the efficiency is further increased. At the same time, the heating element is integrated into the pump casing from the outside such that the heating element does not experience any sealing or insulation problems.

In this case, this outer depression is designed such that a protrusion is formed on the inside of the pump casing. In the heated region, this results in the contact area of the casing being enlarged with respect to the liquid. This measure therefore produces a further increase in the efficiency.

In this case, the outer shape of the pump casing is preferably provided with a structure which enlarges contact area. For this purpose, measures such as a structure with an angled or corrugated cross section, for example, may be considered.

The efficiency can be further increased here by the ratio of what is known as the dead volume $V_t$ of the pump, that is to say the volume of the liquid in the pump (or the total volume of the pump casing minus the volume of the pump impeller), to the maximum total throughput being kept low. A ratio of the dead volume to the maximum total throughput $V_G$ is preferably chosen as follows: $V_T/V_G \leqq 0.2$, preferably $\leqq 0.15$ or $\leqq 0.1$, where $V_T$ is given in [$cm^3$] and $V_G$ is given in [$cm^3$/sec].

In this case, the inner protrusion is preferably oriented along the direction of flow in order to disrupt this pumping action as little as possible. The dead volume of the pump is reduced by the inner protrusion whilst, as described above, the orientation of the protrusion has a scarcely negative effect on the total throughput.

In one advantageous embodiment of the invention, the outer depression is furthermore chosen to be deeper than the corresponding extent of the heating element such that the casing projects beyond the heating element inserted into the depression with a projection. In this way, the contact area is enlarged and the heat loss to the outside is reduced, that is to say the proportion of heat which passes through the casing wall into the liquid within the pump casing is increased. Therefore, this measure also serves to improve the efficiency of the heating system.

In a further advantageous embodiment of the invention, the heating element is pressed against the casing, for example in the depression. Pressing of this type causes particularly narrow and planar contact between the heating element and the corresponding casing part, and accordingly serves to improve the flow of heat from the heating element into the interior of the casing.

In one particular embodiment of the invention, a heat-conducting filler is provided between the heating element and the casing wall. A filler of this type can likewise improve thermal contact. This is especially true when the outer shape of the heating element differs from the shape of the pump casing. Such differences are hard to avoid in the context of customary fault tolerances. Nevertheless, in this case, good thermal contact can be ensured by means of a heat-conducting filler.

In this case, the filler may, for example, be put into place before the heating element is inserted into the depression such that it is again partially displaced when the heating element is pressed in and, as far as possible completely, fills up every intermediate space between heating element and casing wall.

In another embodiment of the invention, a filler of this type is provided in order to secure the heating element at the same time. The filler may, for example, be in the form of an adhesive or in the form of a solder by means of which the heating element is firmly fixed in the casing depression.

The outer shape or the structure of the heating element is preferably designed such that an enlarged contact area is produced in the direction of the corresponding section of the casing wall, and thus in the direction of the interior of the pump. In a particularly simple embodiment, the heating element, as a structure of this type which enlarges contact areas, is designed as an annular segment. An annular segment is particularly advantageous in the case of a cylindrical pump casing. Firstly, virtually the entire circumference of the casing cross section can be covered by means of a single heating element with said annular segment, and secondly the corresponding casing part can be designed as an end-face cover for the pump casing, as a result of which manufacture and assembly are made easier.

The desired contact area can be produced by shaping the cross section of the heating element, for example into a triangular, rectangular, square or trapezoidal shape. These cross-sectional shapes permit a form fit over a large surface area.

Furthermore, manufacture is simplified when the casing depression does not engage behind the heating element, or only does so to an insignificant extent, such that the heating element can be inserted into the depression without substantial deformation of the casing. Slight engagement behind the heating element to form a snap connection may be advantageous in this case. The significant factor here is that the heating element can be inserted after prior separate shaping of the casing.

Another possible option for enlarging the contact area between pump casing and heating element consists in shaping the cross section of the heating element such that a relatively large surface is produced, as seen over the length of the heating element. The cross section can therefore have corrugated or zigzag structures, for example.

Other possible options for providing the heating element with a structure of enlarged contact area consist in designing the heating element to be in the shape of a spiral or of a meander, and/or to have a serpentine or zigzag shape.

All of the embodiments described above and all further conceivable embodiments are suitable for forming the large contact area according to the invention. In this case, the contact area is advantageously larger than half the surface of the heating element, which is given as the minimum size. Therefore, the efficiency can be further improved when the contact area is greater than 60%, 70%, 80% or even 90% of the entire surface of the heating element.

The pump casing is advantageously of two-part design, the heating element being fitted on a casing part. This brings advantages in terms of manufacturing. Firstly, it is easier to shape the depression according to the invention, and secondly a material which is different from the rest of the pump casing can be chosen for the casing part bearing the heating system. For example, a metal which combines good thermal conductivity and high temperature resistance can therefore be used for this casing part. A casing part of this type can be produced cost-effectively in large numbers, for example from a flat material by compression molding or deep-drawing. A suitable plastic, which can be processed for example by injection molding, can be used for the rest of the casing.

In one particularly advantageous embodiment of the invention, the pump is in the form of a centrifugal pump with axial inflow and tangential outflow. A centrifugal pump offers good efficiency in terms of the pumping action and can be readily provided with an integrated heating element according to the invention. In the case of a centrifugal pump, the drive shaft for the pump impeller must firstly be routed out of the casing in a liquid-tight manner and, secondly, the axial inflow is usually fitted on the side opposite the drive.

In this case, the heating system according to the invention can in principle be arranged both on the side of the axial inflow and on the drive side. The embodiment with the heating element on the inflow side offers advantages in terms of manufacture and design. The dimensions of the drive do not need to be matched to the heating element. Furthermore, an inflow, for example in the form of a connection piece, a collar or a flange, can be easily molded by the same shaping method into the casing part, which bears the heating system and also provides the depression according to the invention.

The casing of a centrifugal pump with a heating system fitted according to the invention can be in the form of a cylinder or else a worm, as is frequently the case in centrifugal pumps.

BRIEF DESCRIPTION OF THE SEVERAL VIEWS OF THE DRAWINGS

One exemplary embodiment of the invention is illustrated in the drawing and explained in more detail in the text which follows with reference to the figures.

In detail.

DETAILED DESCRIPTION OF THE INVENTION INCLUDING BEST MODE

Figure 1:
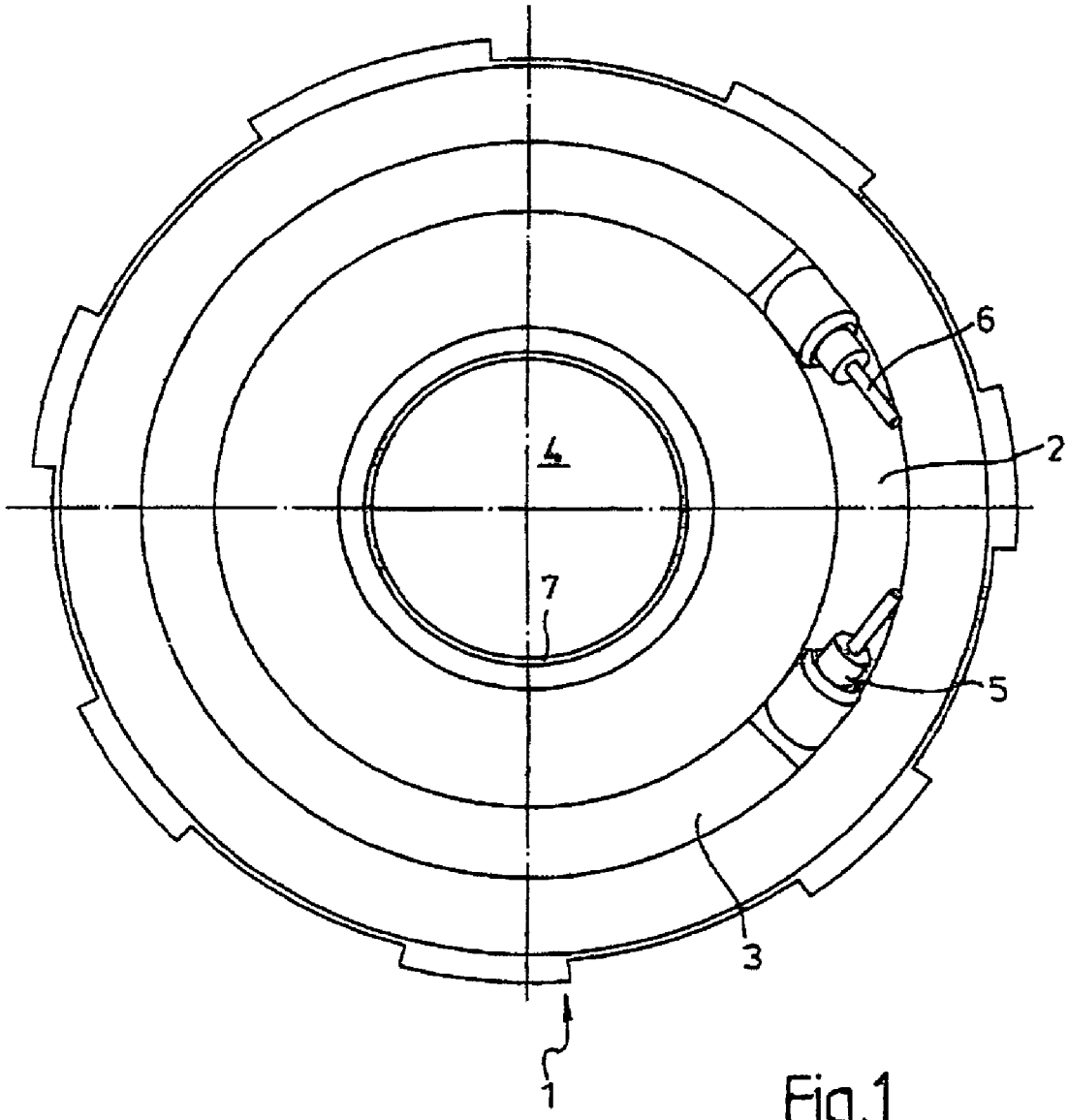
FIG. 1 shows a plan view of a casing part for a pump with a heating element integrated according to the invention.

The casing part 1 according to FIG. 1 is designed as a cover for a further casing part of a centrifugal pump which contains the pump impeller. It has an outer depression in the form of an annular groove 2 into which a heating element 3 bent into an annular segment from a rod-like blank is inserted.

Figure 2:
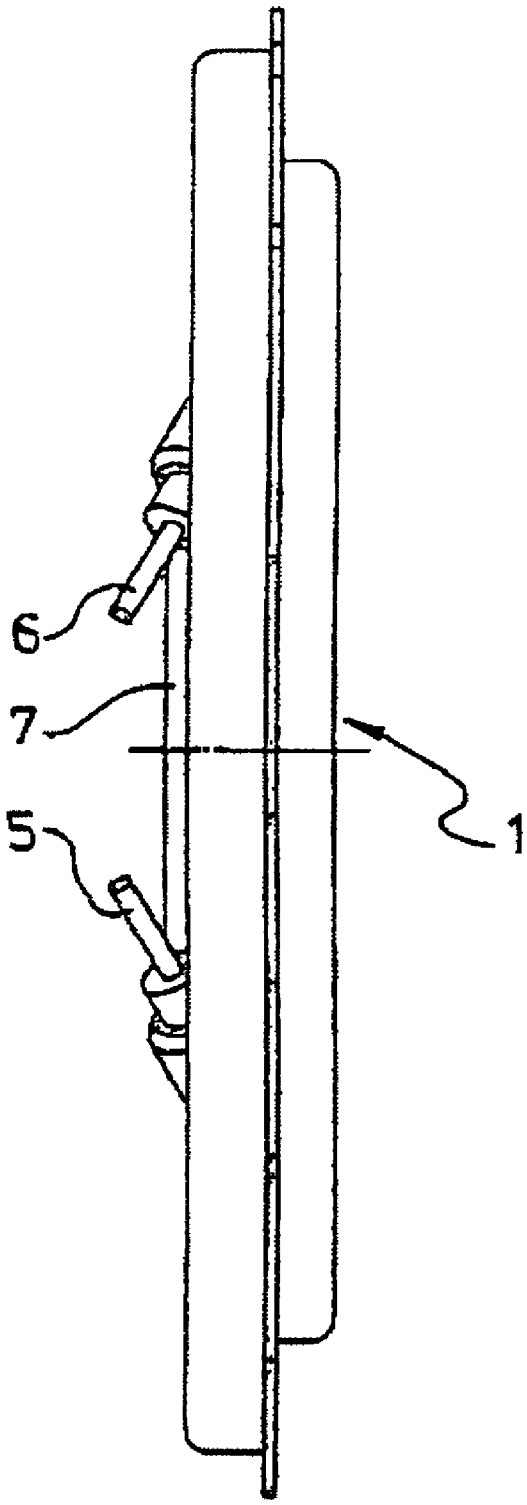
FIG. 2 shows a side view of a casing part according to FIG. 1.

An inflow opening 4 for the axial inflow of the circumferential pump is provided in the center. The connections 5, 6, which are fitted at either end of the heating element 3, are bent away from the annular plane of the heating element 3 such that they protrude out of the annular groove 2 and are therefore easily accessible. The protruding connections 5, 6 can be clearly seen in the symbol view according to FIG. 2.

A collar 7 for connecting an inflow line into the casing part 1 is molded around the inflow opening 4.

Figure 3:
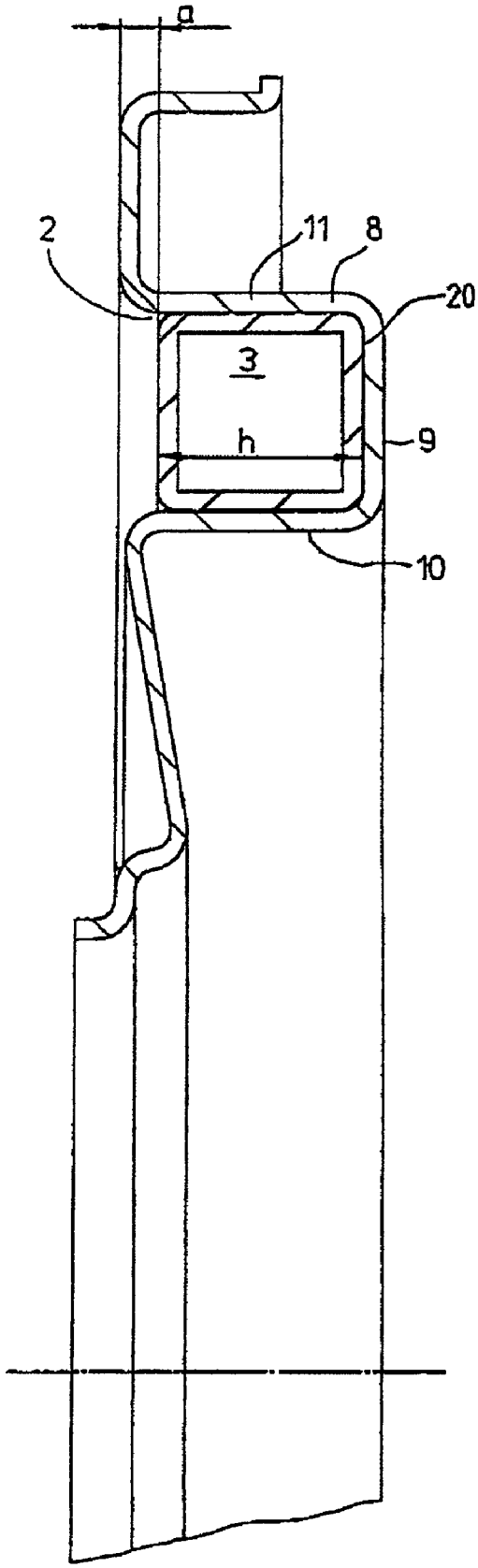
FIG. 3 shows an enlarged detail of the casing part according to FIG. 1 in section.

It can be seen in the enlarged detail according to FIG. 3 that the annular groove 2 is made in a flat material such that a protrusion 8 is produced on the inside. Firstly, this offers advantages in terms of manufacture since the casing part 1 can be produced from a flat material by shaping, and secondly the protrusion 8 enlarges the contact area on the inside of the pump casing formed with the aid of the casing part 1.

The liquid in the interior of the pump to be formed by the casing part 1 flows around both the base 9 and the side walls 10, 11 of the protrusion 8, and the base and the side walls accordingly serve as inner heating area. The formation of the annular groove as an inner protrusion 8 therefore virtually triples the contact area as compared with a heating element placed on a flat casing part.

It can furthermore be seen that the cross-sectional shapes of the heating element 3 and the annular groove 2 are adapted to one another such that the heating element 3 lies in the annular groove 2 with a form fit. This produces large contact areas between the casing part 1 on the one hand and the heating element 3 on the other, these contact areas being joined to one another in a planar manner. If appropriate, a filling material, which is not illustrated in greater detail, can also additionally be provided in order to fill up relatively small gaps between the heating element 3 and the casing part 1 in the annular groove 2, and therefore also to ensure good heat transfer at these points.

As can be seen with reference to FIG. 3, the annular groove 2 is of deeper design than the corresponding height h of the heating element 3 such that the casing part 1 projects beyond the heating element 3 with a projection a. This produces a contact area 20 of approximately 75% of the entire area of the heating element 3 in the case of the essentially square cross section of the heating element in conjunction with thermal contact on three sides. Furthermore, the heating element 3 enters the annular groove 2 to a certain extent. This reduces the proportion of heat emitted to the outside. The side walls 10, 11, which are available for transferring heat to the liquid, are enlarged by the projection a. In the material of the casing part 1, the heat not only flows perpendicularly with respect to the side walls 10, 11 from the heating element 3 into the interior of the pump casing to be closed by the casing part 1, but it also spreads within the casing part 1, for example to the upper extension of the side walls 10, 11. Accordingly, these regions of the side walls 10, 11 additionally serve to output heat to the liquid. This measure correspondingly further improves the efficiency of the heating element 3.

The casing part 1, which is preferably made of heat-conducting and temperature-resistant material, for example of metal, can be connected to at least one further casing part in many different ways. For example, a releasable connection such as a latch or snap connection, if appropriate with corresponding sealing elements, can thus be provided. However, firm connection to the further casing part, for example by adhesive bonding, soldering or welding, is also conceivable.

Figure 4:
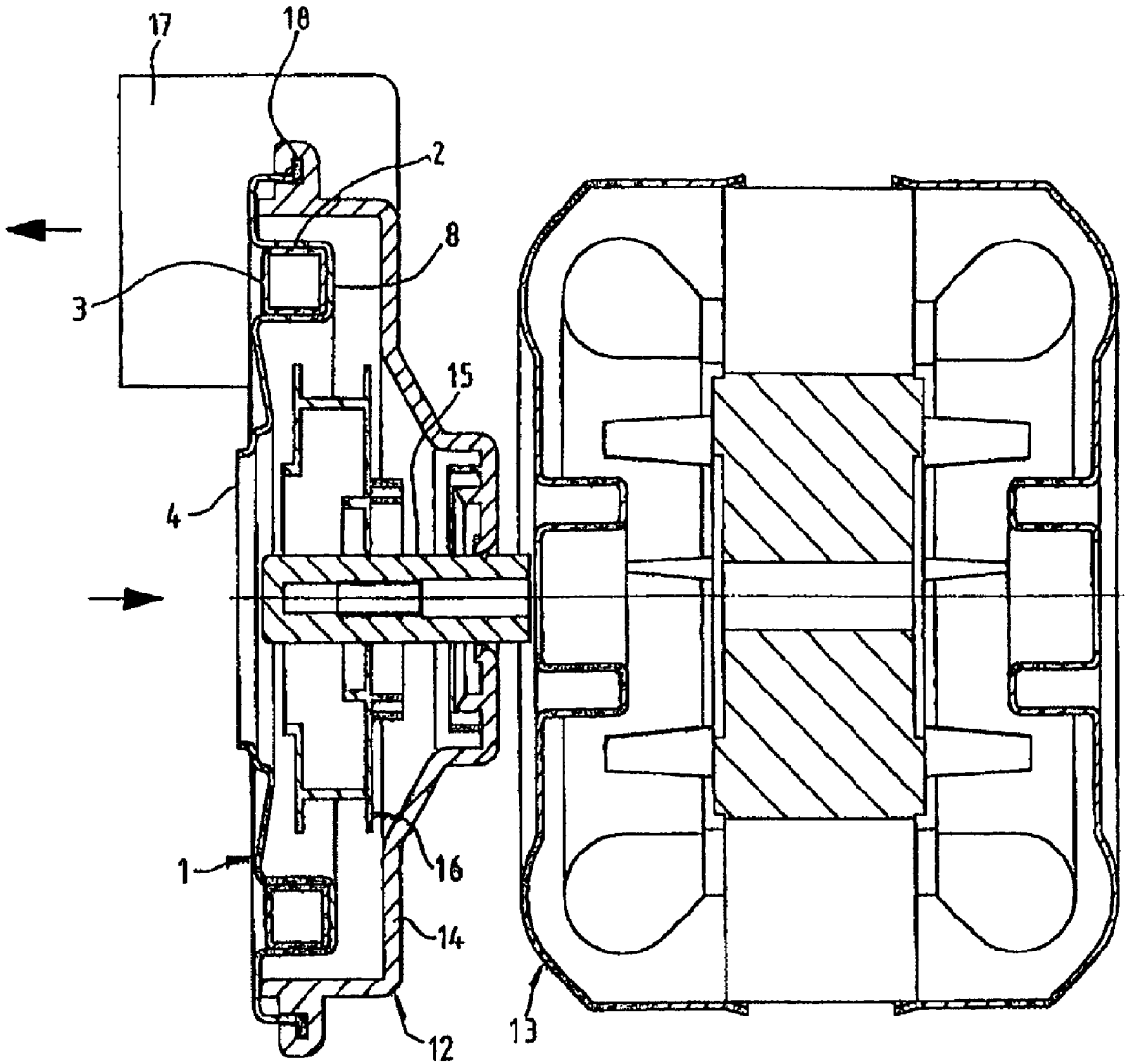
FIG. 4 shows a sectional illustration of a complete pump.

FIG. 4 shows a complete pump 12 with drive motor 13 and heating element 3 according to the invention. The casing part 1 described above serves as a cover for a further casing part 14. The drive shaft 15 of the drive motor 13 passes through the casing part 14. The passage of the drive shaft 15 is sealed off in a manner not illustrated in greater detail.

A pump impeller 16 is secured to the drive shaft 15. Liquid flows in via the inflow opening 4. Liquid flows out tangentially into an outflow connection piece 17, where the flow is diverted in parallel with the inflow.

In this embodiment, the casing part 1 is firmly connected to the casing part 14. For this purpose, the edge region 18 of the metal casing part 1 is extrusion-coated whilst the other casing part 14, which comprises plastic, is being manufactured. However, releasable variants, which may be additionally sealed off if appropriate, are also conceivable here, as mentioned above.

A wide variety of further refinements are conceivable by comparison with the illustrated exemplary embodiment, the essential factor according to the invention being that the heating element is inserted into an outer depression of the pump casing. The casing part 1 accordingly tightly closes off the pump casing to be formed. The heating element 2 and, respectively, its electrical connections 5, 6 do not experience any sealing and/or insulation problems. Furthermore, a casing part 1 with a heating element 3 inserted according to the invention is particularly easy and therefore cost-effective to manufacture.

LIST OF REFERENCE NUMERALS

1 Casing part
2 Annular groove
3 Heating element
4 Inflow opening
5 Connection
6 Connection
7 Collar
8 Protrusion
9 Base
10 Side wall
11 Side wall
12 Pump
13 Drive motor
14 Casing part
15 Drive shaft
16 Pump impeller
17 Outflow connection piece
18 Edge region
19 Heating element
20 Contact area

What is claimed is:

1. A household appliance having a liquid circuit and a pump having a pump casing with a heating element for heating a liquid, said heating element having a heat-conducting contact area with at least a partial form fit to fit in an outer shape (2) of the casing (1) with a contact area (20) on an outside surface of the casing being at least half the size of the entire outer area of the heating element which outside surface of the casing faces away from the tub interior and a liquid circuit wherein the improvement comprises an outer depression in a casing (1) that projects into a liquid circuit and faces a pump shaft 15 and pump impeller 16 said outer depression forming a protrusion (8) on an inside surface of said casino a first channel and a first heating area substantially surrounding said pump impeller and a second channel and a second heating area in substantial axial and radial alignment with said first channel and said first heating area and an annular groove (2) on the outside surface for mounting said heating element (3) into said casing, said casing having a depression deeper than the corresponding height (h) of the heating element (3) and said protrusion (8) on the inside of said casing (1) having a projection (a) on the outside of said casing projecting beyond the height (h) on both sides of said heating element in said annular groove (2).

2. The household appliance as claimed in claim 1 wherein the outer shape of the casing has an enlarged surface area.

3. The household appliance as claimed in claim 1 or 2 wherein a ratio of dead volume to total throughput $V_t$ [$cm^3$]/$V_G$ [$cm^3$/sec] is $\leqq 0.2$.

4. The household appliance as claimed in claim 1 or 2 wherein said protrusion is oriented along the direction of flow.

5. The household appliance as claimed in claim 1 or 2 wherein the heating element (3) is disposed against the casing (2).

6. The household appliance as claimed in claim 1 or 2 further comprising a heat-conducting filler disposed between the heating element (3) and the casing wall (9, 10, 11).

7. The household appliance as claimed in claim 1 or 2 further comprising a heat-conducting filler securing the heating element (3) to the casing wall (9, 10, 11).

8. The household appliance as claimed in claim 1 or 2 wherein said heating element (3) is a flat sided material mounted into an annular segment of said outer depression (2) constructed from a rod-like blank.

9. The household appliance as claimed in claim 1 wherein said casing is of two-part design and the heating element (3) is fitted on a casing part (1).

10. A liquid pump for a household appliance having a pump casing including a heating element for heating a liquid, which heating element has a heat-conducting contact area mounted to the outer shape (2) of the casing (1) with an at least partial form fit, the contact area (20) on an outside surface of the casing being at least half the size of the entire outer area of the heating element that does not project into and faces away from the tub interior and a liquid circuit, wherein the improvement comprises a casing having a depression (2) that projects into a liquid circuit for mounting the heating element (3) into an outer depression (2) on the outside surface of the pump casing such that the pump casing (1) provides a projection (8) on the inside of said pump casing and a first heating channel that projects into a liquid circuit to or beyond the height (h) of the heating element (3) forms a projection (a) on both sides of the heating element said projection (a) also forming a second heating channel displaced in substantial axial and radial alignment to said first heating channel on the inside of said pump casing.

11. A household appliance heating element device comprising:

(a) a substantially circular pump plate having an inside surface and an outside surface and a flat sided groove projecting inwardly around a pump impeller forming two heating channels in substantial axial and radial alignment projecting into a liquid circuit and terminating in a projection (a) disposed on said inside and outside surface and disposed intermediate the ends of said substantially circular pump plate;

(b) a flat sided heating element disposed in said flat sided groove on said outside surface of said substantially circular pump plate having a height (h) that does not extend into projection (a);

(c) a pump impeller facing said inside surface of said flat sided groove and in substantial axial and radial alignment with said two heating channels, said inside surface of said substantially circular plate forming one end of a pump impeller housing;

(d) a pump impeller closure forming the other end of said pump impeller housing connecting with the terminal end of said projection (a);

(e) a first heating area disposed on said inside surface around said pump impeller and defined by a side of said flat sided groove; and (f) a second heating area disposed around a channel formed in connecting said projection (a) of said flat sided groove with said pump impeller closure.

12. The household appliance heating element device of claim 11 further comprising a second flat side to said flat sided groove and a third heating area disposed on said second flat side of said flat sided groove.

13. The household appliance heating element of claim 11 wherein said groove is U-shaped.

14. The household appliance heating element of claim 11 wherein said heating element is of a substantially rectangular cross section for fitting into said U shaped groove.

* * * * *